United States Patent [19]

Bingler

[11] Patent Number: 4,526,507

[45] Date of Patent: Jul. 2, 1985

[54] SHAFT DRIVEN PUMP WITHOUT SEALS

[75] Inventor: Douglas J. Bingler, Furlong, Pa.

[73] Assignee: Milton Roy Company, St. Petersburg, Fla.

[21] Appl. No.: 388,163

[22] Filed: Jun. 14, 1982

[51] Int. Cl.[3] ..... F04B 17/00

[52] U.S. Cl. ..... 415/170 B; 415/143; 415/149 R; 415/170 R; 417/368

[58] Field of Search ..... 415/100, 143, 179 R, 415/179 A, 170 R, 170 B, 62, 97, 98, 149 R, 170 A; 417/368, 423, 424

[56] References Cited

U.S. PATENT DOCUMENTS

| | | | |
|---|---|---|---|
| 2,450,137 | 9/1948 | Harlamoff | 103/87 |
| 2,687,695 | 8/1954 | Blom et al. | 103/87 |
| 2,711,332 | 6/1955 | Audemar | 415/170 B |
| 2,768,584 | 10/1956 | Nicol et al. | 103/87 |
| 2,769,105 | 10/1956 | Altschwager et al. | 310/88 |
| 3,407,994 | 10/1968 | McKinney | 415/170 A |
| 4,065,232 | 12/1977 | Stratienko | 417/368 |
| 4,088,424 | 5/1978 | Hyatt et al. | 417/423 A |
| 4,226,575 | 10/1980 | Hyatt et al. | 417/423 A |
| 4,295,797 | 10/1981 | Ruhl et al. | 417/203 |

FOREIGN PATENT DOCUMENTS

| | | | |
|---|---|---|---|
| 222863 | 11/1942 | Switzerland | 415/170 B |
| 226992 | 8/1943 | Switzerland | 415/170 B |
| 587372 | 4/1947 | United Kingdom | 415/170 B |
| 1389222 | 4/1975 | United Kingdom . | |

*Primary Examiner*—Robert E. Garrett
*Assistant Examiner*—John Kwon
*Attorney, Agent, or Firm*—Woodcock Washburn Kurtz Mackiewicz & Norris

[57] ABSTRACT

A sealless fluid pump apparatus has a primary pump moving fluid from an inlet through an outlet of the apparatus and a secondary pump adjoining the primary pump. Shaft means driving the two pumps extends through a portion of the housing separating the two adjoining pumps as well as through another portion of the housing separating the two pumps from a motor or other means driving the shaft means. No seals are provided where the shaft means extends through the housing. Rather, the secondary pump operates to resist the flow of fluid between the shaft means and housing into the secondary pump.

2 Claims, 7 Drawing Figures

SHAFT DRIVEN PUMP WITHOUT SEALS

BACKGROUND OF THE INVENTION

The invention relates to apparatus for pumping fluids and more particularly, to a design for a shaft driven pump for liquids which eliminates the necessity of a seal about the driving shaft where it enters the pump casing.

Pumps are typically either of a shaft or shaftless design. This invention relates to the former. Such pumps typically comprise a motor or some other driving mechanism, a pump casing or chamber housing a rotor or other impeller and a shaft connecting the driving mechanism to the impeller for actuating the same. A mechanical seal is generally provided about the shaft where it penetrates the pump chamber so as to prevent leakage of the fluid being pumped and to otherwise maintain fluid pressure created by the impeller to assure efficient pumping.

There are significant negative aspects associated with such seals. Typically, seals are subject to wear or damage necessitating their replacement as well as possible replacement of the shaft. Also, contact between the seal and the shaft causes frictional drag upon the shaft reducing pump efficiency. Moreover, a sufficiently high initial torque must be provided to overcome standing friction between the seal and the shaft when the latter is initially rotated imposing further constraints on the motor or other drive mechanism selected to drive the impeller.

Various "sealless" pump designs have been proposed to overcome some of these problems. For example, U.S. Pat. No. 4,065,232 describes a vertically oriented shaft driven "sealless" centrifugal type fluid pump. Fluid leaking from the pump chamber rises about the shaft into a sealed adjoining upper chamber where gas is introduced to control the level of the fluid. A conduit is provided to the inlet of the pumping chamber and is used to remove excess fluid from the upper chamber. This system requires a gas source as well as auxiliary equipment controlling the introduction of gas into and monitoring the level of fluid within the upper chamber.

As will be described subsequently in greater detail, applicant's invention involves the use of a second impeller in a sealless pump design to control fluid leakage from a primary pumping chamber along the pump drive shaft. Of relevance to this aspect of my invention is British Pat. No. 1,389,222. That patent describes a vertically oriented shaft driven pump for liquid fuels having a primary pump chamber at the bottom of a pump housing, a secondary pump chamber above the primary pump chamber and a motor housing above the two pumping chambers. A shaft extends from the motor through the secondary chamber and into the primary chamber where it drives a primary pump centrifugal type rotary impeller. The shaft also drives a secondary centrifugal type rotary impeller in the secondary pump chamber which removes liquids leaking into the secondary chamber and draws air from the motor housing to prevent fumes from the pumped fuel from invading the motor. The indicated design does not dispense with seals as a conventional mechanical seal is supplied around the shaft between the primary and secondary pumping chambers. Lastly, a separate outlet must be provided for the removal of fluids (fuel, fumes and air) from the secondary chamber, additionally complicating its design and increasing manufacturing costs.

Also of relevance to the multiple impeller aspect of my invention is a class of fluid pumps represented by U.S. Pat. Nos. 4,088,424 and 4,226,575 used with wet pickup vacuum cleaners and/or rug shampooers. Each patent describes a pump apparatus comprising a plurality of impellers mounted upon and driven by a common shaft for rotation. The impellers operate in two chambers defined by walls of the apparatus housing. A fluid path is provided between the chambers by an opening about the impeller drive shaft. Fluid entering the apparatus and first chamber through an inlet is urged through the opening and into the second chamber where other impellers urge the fluid towards an outlet from that chamber and the apparatus. The function of at least one impeller in the second chamber of each invention is to create a pressurized air barrier preventing the fluid being pumped, a mixture of air, moisture and perhaps other liquids, from travelling to the base of the impeller drive shaft and into contact with the motor or its bearings. The one impeller acts as a blower drawing air from an external source and pumping it under pressure into the fluid being moved by the remaining impellers causing the pumped fluid to continue along a path towards the outlet. The air seal thus formed by the pressurized air is undesirable in certain applications as air is mixed into the fluid being pumped. It is also believed the system would be ineffective against fluids which are entirely or primarily liquid.

OBJECT OF THE INVENTION

It is a first object of the invention to provide a novel design for a sealless pump.

It is yet another aspect of the invention to provide a sealless pump of simple design which is easy to manufacture.

It is yet another object of the invention to provide a sealless shaft driven liquid pump which does not mix air into the liquid being pumped.

It is yet another object of the invention to provide a pump of sealless design for use with an ice making apparatus which does not entrap air in the pumped water.

SUMMARY OF THE INVENTION

The aforesaid objects of the invention and other objects are accomplished by my invention in which an apparatus is provided having a first or primary pump means for pumping fluid in a conventional fashion between an inlet and an outlet of an apparatus. The first pump means is driven by shaft means extending through a wall of the first pump means. In lieu of a conventional mechanical fluid seal, a first fluid gap is provided through the wall and about the shaft. Thus, although the shaft is free to rotate without the constrictions imposed by a contacting mechanical seal, fluid can escape primary pump means through the fluid gap. A second pump means is provided in fluid communication with said first gap and driven by the same shaft means for resisting the flow of fluid through the first fluid gap from the first pump means.

According to a preferred embodiment of my invention, a housing is provided having a first or primary pumping chamber and a second or secondary pumping chamber adjoining the primary pumping chamber. A first or primary impeller is provided in the primary pumping chamber to form with the primary chamber a primary pump which moves fluid entering the apparatus through an inlet leading into the primary chamber, to and through an outlet leading from the primary chamber and apparatus. Shaft means from a motor or other shaft driving means is provided extending through the secondary pumping chamber and into the primary chamber to drive the primary impeller. A first partition means of the apparatus housing separates and forms walls of the adjoining primary and secondary pumping chambers. A second partition means of the housing forms a second wall of the secondary pumping chamber and separates the primary and secondary pumping chambers from the remainder of the apparatus including the motor or other shaft driving means. Each partition means has a central opening through which the shaft means extends. A fluid gap is provided between the surface of the shaft means and the opening of each of the partition means where, in conventional designs, a mechanical seal would normally be provided. A portion of the fluid entering the primary chamber passes through the first gap between the first partition and shaft means and into the secondary pumping chamber. A centrifugal type second or secondary rotary impeller is provided in the secondary pumping chamber and is also driven by the aforesaid shaft means. Fluid entering the secondary chamber eventually enters and primes the secondary impeller. The primed secondary impeller resists the flow of the fluid into the second chamber and towards the second gap between the second partition opening and the shaft means. The design requires only the provision of the second pump (i.e. secondary pumping chamber and secondary impeller) in place of a conventional mechanical seal to control leakage of the pumped fluid along the shaft while the primary pump is operating.

According to one important aspect of the described preferred embodiment of the invention, the shaft means is multipieced. A primary rotary impeller is provided in the primary pump and has a first shaft extending therefrom which is sufficiently long to extend through the first partition means and into the secondary pump. A second shaft is provided extending from the motor or other drive means and is joined by suitable means with the first shaft.

According to one important feature of the preferred embodiment, the primary impeller and first shaft are formed monolithically to simplify assembly and reduce costs.

According to yet another important aspect of the preferred embodiment, the second pump is provided with a centrifugal type rotary impeller having a central bore through which an end of the first shaft is passed for engagement of the second impeller with the first shaft. The first shaft is tapered along at least a portion of its length as it extends away from the first impeller and the second impeller is press fitted into frictional contact engagement with the other surface of the first shaft along the tapered portion of its length. This also simplifies assembly and reduces costs.

According to yet another important feature of the invention, where either rotary impeller is of the centrifugal type and is formed by a plurality of radially extending vanes, a backing plate is also provided so as to limit the amount of air drawn by the impeller and mixed with the pumped fluid. This is an advantage in some applications such as pumping water for icemaking where the mixture of air into the pumped water causes undesired clouding of the ice subsequently formed.

The preferred embodiment of the invention is designed to pump water into a reservoir maintained at a level above the primary and secondary pumping chambers. Thus a head remains at the outlet when the pump is turned off forcing water above the two pump chambers. To prevent water from contacting the motor or other drive mechanism, the pump is vertically oriented with the primary pumping chamber located at the bottom and the motor at the top. A third portion of the housing, a reservoir chamber, is provided beneath the motor or drive means and above the primary and secondary pump chambers to raise the motor above the water level of the reservoir with which the apparatus is used. The secondary pump moves water which has entered the reservoir chamber when the apparatus is not pumping, from that chamber and through the first fluid gap into the primary pump for pumping from the apparatus.

DETAILED DESCRIPTION OF THE DRAWINGS

The invention shall now be described with reference to the accompanying drawings in which:

FIG. 1 is an exploded view of a preferred sealless water pump apparatus according to the present invention;

FIG. 2 is a partially broken away vertical view of the apparatus in FIG. 1; FIG. 3 is a view of the bottom of the apparatus of FIGS. 1 and 2 depicting the fluid inlet and fluid outlet locations; FIG. 4 is a sectional overhead view of the apparatus of the previous figures depicting part of the upper surface of the secondary impeller and a partition plate over the impeller;

DETAILED DESCRIPTION OF THE INVENTION

Figures 1, 7:
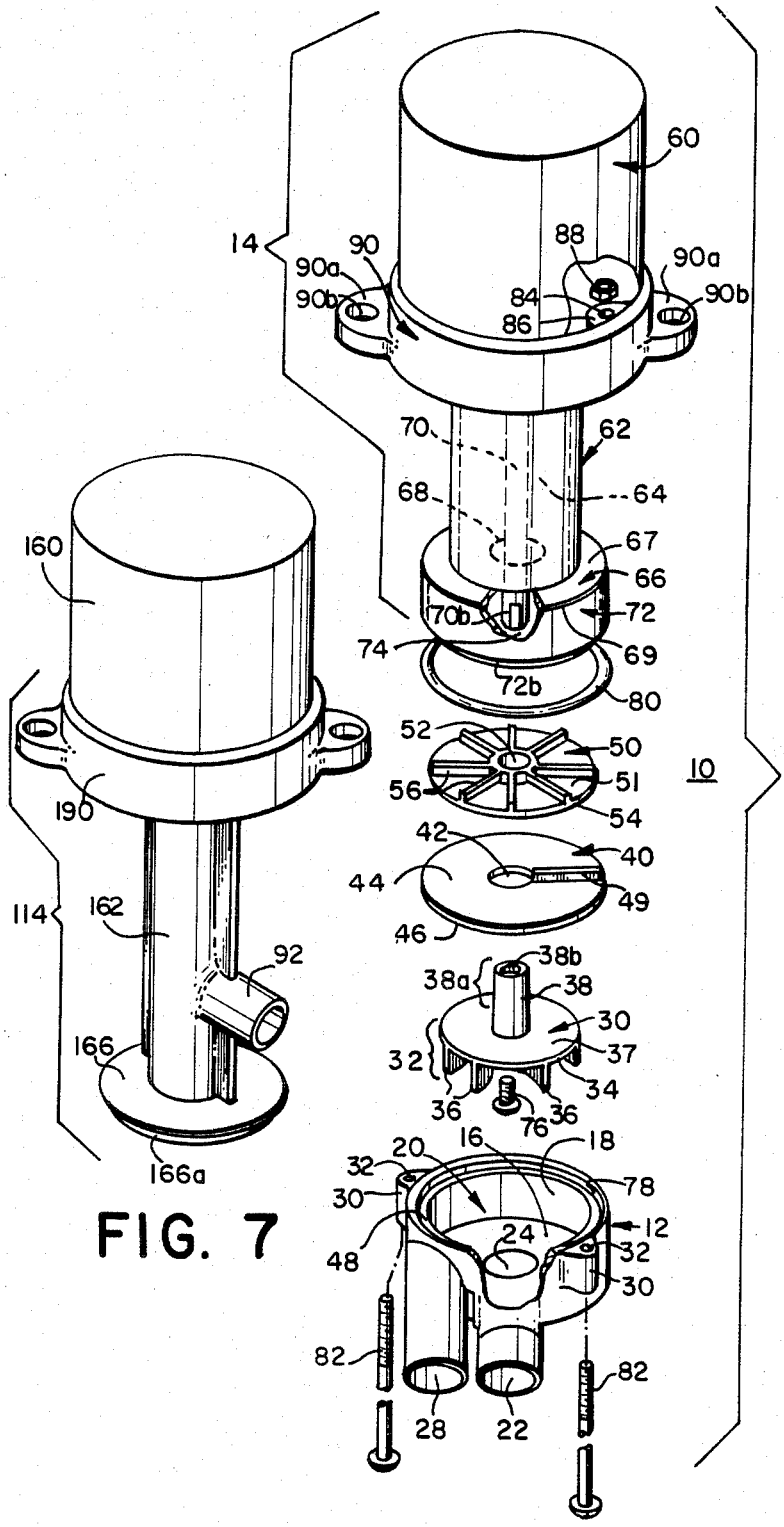
FIG. 7 depicts an alternate component of the apparatus of FIGS. 1 through 6.

FIG. 1 depicts in an exploded view, a preferred embodiment of the present invention which is a small water pump apparatus 10 designed for use with an ice maker. A base piece 12, an upper assembly 14 and a partition plate 44 between the two are the primary components of a housing of the apparatus 10. A floor 16 and cylindrical sidewall 18 of a primary pumping chamber 20 are formed by interior surfaces of base 12. A fluid inlet 22 is provided at the bottom of the base 12 leading to an opening 24 approximately in the center of the floor 16. Fluid entering the primary pumping chamber through the inlet 22 and opening 24 is pumped through an opening 26 (See FIG. 6) in the sidewall 18 leading to outlet 28 extending from the primary pumping chamber 20 and the apparatus 10. A pair of tabs 30 each having a bore 32 extending vertically therethrough are provided on either side of the base 12 for attachment to upper assembly, as will be later described. A primary centrifugal acting rotary impeller 32 is formed by a backing plate 34 and a plurality of radial vanes 36 extending from the lower surface of the plate 34 as shown in FIG. 1. The vanes 36 are curved as they extend radially outward from the "eye" or center of the impeller 32 to reduce cavitation and improve pump efficiency. One skilled in the art will appreciate that the vanes 36 may also be formed to extend outwardly in a straight fashion parallel to radii from the center of the impeller 32, if desired. One so skilled will further appreciate that other types of rotary impeller and other shaft driven types of pumps may be suitable for use as the primary pump. A short hollow shaft 38 extends from the upper surface 37 of the backing plate 34. The impeller 32 and shaft 30 may be formed monolithically from plastic or other suitable materials to reduce assembly steps and costs. The impeller portion 32 of the assembly 30 is positioned with the primary pumping chamber 20 in the base 12 for operation. The partition plate 40 has a central opening 42 and upper and lower opposing surfaces 44 and 46 between which the opening 42 extends and is positioned over the impeller 32 with the short shaft 38 extending through the opening 42. A suitable recess 48 is provided in the top of the base 12 to receive the plate 40. The lower surface 46 of the plate 40 defines the upper wall of the primary pumping chamber 20. A second rotary impeller 50 having a central bore 52 is positioned over the plate 40 with the upper end 38*a* of the shaft 38 extending through the bore 52. For convenience of assembly, the shaft end 38*a* is preferably slightly inwardly tapered along its length and the opening 52 dimensioned to allow the secondary impeller 50 to be jam fitted into frictional engagement with the shaft 38. Of course, other conventional methods may be employed to fixedly mount the impeller 50 to the shaft end 38*a*. The secondary impeller 50 is also of the centrifugal type and is formed by a backing plate 54 and a plurality of straight, radially extending vanes 56 projecting upwardly from an upper surface 51 of the backing plate 54 (as viewed in FIG. 1) away from the primary chamber 20. Again one skilled in the art will appreciate that curving vanes similar to the vanes 36 of the primary impeller 32 or other rotary impeller configurations may be employed, if desired.

The upper housing assembly 14 of the pump 10 includes a plate 90 mounting a motor or other shaft driving means, indicated diagrammatically by a cylinder 60. A third, "reservoir" chamber 64 is formed beneath the mounting plate 90 by a hollow cylindrical section 62 and the upper surface 67 of the second partition plate 66. By way of example, the upper surface 67 of the second partition plate 66 and lower surface of the mounting plate 90 may be grooved to receive the edges of a separate cylinder 62 as depicted, for one assembly technique, or the mounting plate 90, cylinder 62 and second portion plate 66 or any adjoining pair fabricated as an integral component.

A shaft 70 is provided extending from the motor or other drive means 60 to rotate the primary and secondary impellers 32 and 50. It will be appreciated by one skilled in the art that a conventional electric motor may be provided as the means 60 or that a mechanical or electromechanical linkage may be provided between the shaft 70 and a distantly located power source for operation of the apparatus 10. The second partition plate 66 has a central opening 68 through which the shaft 70 extends. A second cylindrical section 72 forms with a lower surface 69 of the second partition plate 66 and the upper surface 44 of the first partition plate 40 a secondary pumping chamber 74 within which the secondary impeller 50 operates. Thus, the second partition plate 66 forms an upper wall of the secondary pumping chamber 74 and serves to separate the two chambers 20 and 74 from the remainder of the apparatus 10. The primary chamber 20 and shaft driven primary impeller 32 comprise a primary pump while the secondary chamber 74 and secondary impeller 50 comprise a secondary pump. A stationary vertical plate 49 is provided in the second pump to break up vortices which tend to form beneath the backing plate 54, but is optimal.

The apparatus 10 is assembled as follows. After the first partition plate 40 has been placed over the shaft 38 of the assembly 30, the secondary impeller 50 is jammed into frictional engagement with the tapered end 38*a* of the shaft 38. The assembly 30 is hollow along its center and the opening 38*b* of the shaft 38 has been "D" keyed to receive a similarly contoured end 70*b* of the shaft 70. The end 70*b* of the shaft 70 is fixed to the first hollow shaft by suitable means such as a screw 76 extending upward through the hollow interior of the assembly 30 and into the end 70*b* of the shaft 70. The upper portion 14 of the housing is then joined to the base 12. The second cylindrical section 72 has a slightly recessed lower cylindrical surface 72*b* which fits into a suitably contoured mating surface 78 of the base 12 with an O-ring seal 80 therebetween. The base 12 is held to the upper assembly 14 by suitable means such as a pair of bolts 82 which are inserted through the bores 32 of the tabs 30 and through bores 84 of tabs 86 provided in the mounting plate 90 and are each held in place by a nut 88 or other suitable fastening means. The mounting plate 90 is provided with a pair of larger tabs 90*a* with bores 90*b* for mounting the apparatus 10 to an appropriate support. Thus assembled, rotation of the shaft 70 by the drive means 60 causes similar simultaneous rotation of the primary and secondary impellers 32 and 50.

Figure 2:
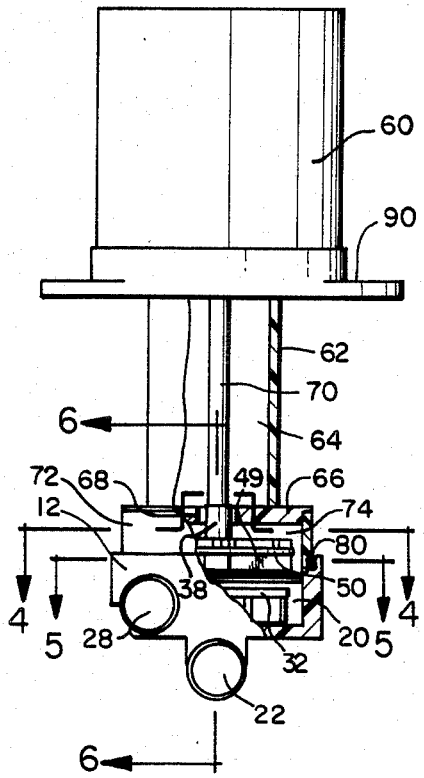
Figure 3:
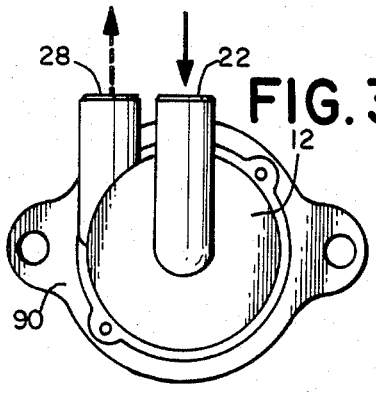
Figure 4:
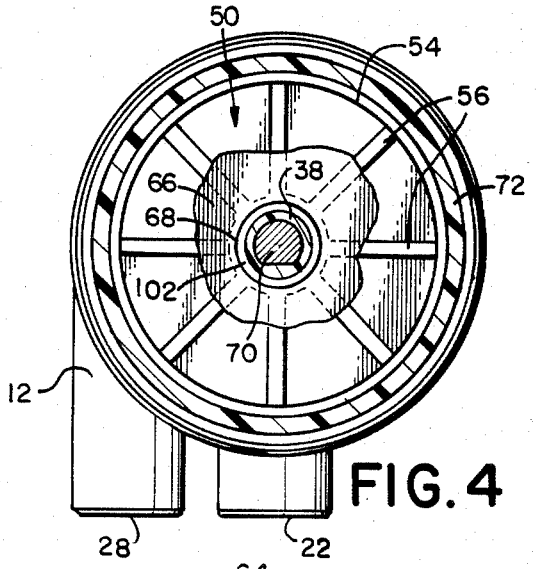
Figure 5:
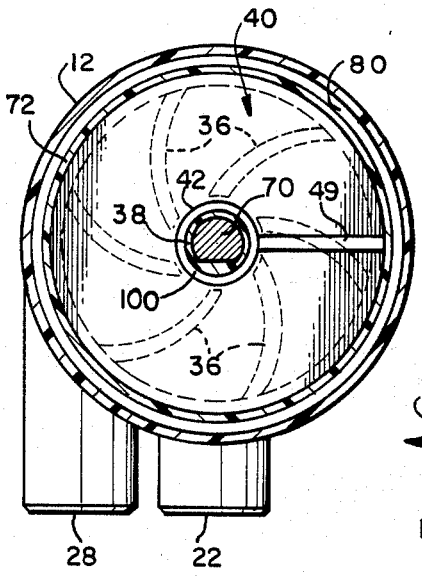
FIG. 5 is another sectioned overhead view of the apparatus of the previous figures depicting the first partition between the primary and secondary chambers and, in phantom, the primary impeller.

The assembled pump 10 is depicted in vertical and bottom views in FIGS. 2 and 3, respectively. The assembled pump 10 has been partially broken away in FIG. 2 to reveal the primary impeller 32 positioned in the primary pumping chamber 20 and the secondary impeller 50 in the secondary pumping chamber 74 above the primary chamber 20 as well as the third reservoir chamber 64 between the secondary chamber 74 and the shaft driving means 60. As can be seen in FIG. 2 and better seen in FIGS. 5 and 4, a first gap 100 exists between the opening 42 of the first partition plate 40 and the outer diameter of the short shaft 38 and a second gap 102 exists between the opening 68 of the second partition plate 66 and the outer diameter of the short shaft 38.

Figure 6:
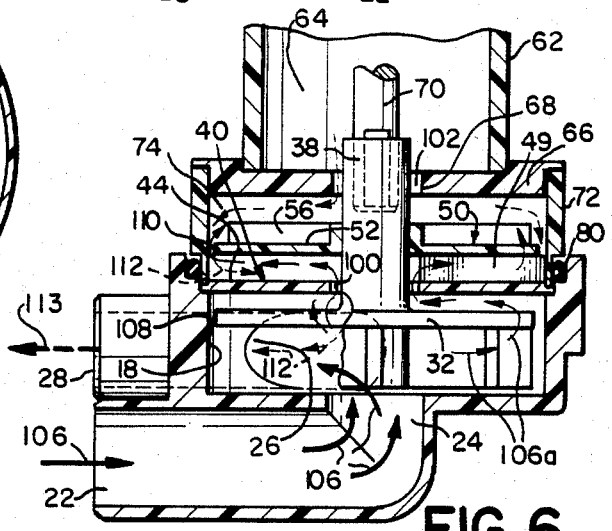
FIG. 6 is a partially sectioned vertical view of the apparatus of the previous figures depicting the fluid path from the pump inlet to the pump outlet and through the primary and secondary pumping chambers.

Fluid flow during operation of the pump 10 of FIGS. 1–5 is depicted in FIG. 6 which is a side-sectioned vertical view of the lower portion of the apparatus 10. Incoming fluid, indicated by heavey solid lined arrows 106 enters the pump assembly 10 and primary pumping chamber 20 through the inlet 22 and opening 24, respectively. Rotation of the primary impeller 32 causes a pressure differential to be created with a lower pressure at the eye or center of the primary impeller 32 drawing the fluid 106 into the primary pumping chamber 20 and a higher pressure at the radial extremities of the impeller 32 moving the fluid towards the side wall 18 and through the opening 26 and outlet 28. Although most of the fluid will flow through the opening 26, a portion of the fluid, indicated by the lighter solid-lined arrows 106*a* will also flow around the radial edge of the impeller 32 and through a space 108 between the radial edge of the impeller 32 and cylindrical wall 18 of the chamber 20. The fluid 106*a*, pressurized by the impeller 32, flows towards the short shaft 38 and through the first fluid gap 100 into the secondary pumping chamber 74.

The fluid 106*a* continues travelling between the upper surface 44 of the first partition plate 40 and beneath the backing plate 52 of the secondary impeller 50, around a space 110 between the radial edge of the secondary impeller 50 and the inner surface of the cylindrical section 72 forming the sidewall of the secondary pumping chamber 74 and towards the gap 102 between the second partition plate 66 and the outer diameter of the short shaft 38. As this fluid 106*a* enters the secondary impeller 50 (i.e. enters the area swept by the vanes 56), it primes the secondary pump formed by the impeller 50 and chamber 74. The centrifugal action of the rotating impeller 52 creates a pressure differential in the fluid 106*a* urging it away from the eye of the secondary impeller 50 and the second gap 102. Depending upon the design of the secondary pump (i.e. second impeller 50 and chamber 74), flow of the fluid 106*a* towards the second gap 102 will be slowed or, preferably, halted. In the indicated embodiment, flow of the fluid through the second fluid gap 102 will be determined by a number of factors including the fluid head at the inlet 22, the relative diameters of the two impellers 32 and 50 and the space between the top of the second impeller 50 and lower surface 69 of the second partition plate 66. This space has been greatly exaggerated in FIGS. 2 and 6 for clarity. One way in which to prevent fluid from entering the second gap 102 is to make the diameter of the second impeller 32 (as measured normal to the shaft 38) sufficiently greater than that of the primary impeller 32. Where no appreciable fluid head occurs at the inlet 22, a second impeller 50 diameter approximately equal to that of the first impeller 32, as depicted, will typically suffice. In this case, the fluid will be held at some equilibrium radius from the center of the impeller 50 and gap 102 while the impellers 50 and 32 are being rotated. Furthermore, this is true regardless of the speed of rotation of the impellers in the depicted embodiment.

The apparatus depicted in FIGS. 1 through 6 is designed to pump water into the holding tank of an associated ice making apparatus (not depicted) where the level of the water is typically held above the height of the two impellers 32 and 50. Thus, a fluid head is maintained at the apparatus outlet 28 and opening 26 which causes water to flow back from the holding tank into the apparatus 10 and to rise through the first and second gaps 100 and 102, respectively, and into the reservoir chamber 74 when the impellers 32 and 50 are not being driven. The reservoir chamber 74 raises the drive means 60 above the highest level of the water in the associated holding tank (not depicted). When the drive means 60 is reactivated, the impeller 50 moves fluid from the reservoir chamber 74 through the second gap 102 and first gap 100 and into the primary pumping chamber 20, as is indicated by the lighter broken-lined arrows 112, until the reservoir chamber 74 is drained and an equilibrium fluid position is again reached in the second impeller 50.

The backing plates 34 and 54 of the primary impeller 32 and secondary impeller 50, respectively, prevent either impeller from drawing and mixing air into the fluid being pumped. In icemaking applications, injected air causes pumped water to freeze into a cloudy ice which is less appealing. They further improve the efficiency of the two impellers 32 and 50.

There are no mechanical seals to wear or to otherwise impede movement of the shaft portions 38 and 70. The secondary impeller 50 contributes virtually no drag until that impeller is primed. Moreover, even when primed, the secondary impeller 50 generates less drag than normally will be generated by a conventional mechanical seal. As more fluid enters the area swept by the secondary impeller 50, it becomes better primed and its pumping action more efficient. The depicted embodiment operates to prevent the upward migration of the water through the second fluid gap 102 over the entire operation range of the apparatus, even where the outlet 28 has been sealed.

Turning now to FIG. 7, there is shown an alternate design upper housing assembly 114 which is substantially identical to the upper housing assembly 14 of FIG. 1. A reservoir chamber 162 of the alternate assembly 114 has been considerably diminished in size by the provision of a cylindrical section 162 having an inner diameter only slightly larger than the outer diameter of a pump driving shaft 170. Also, an outlet 92 has been provided in the side of the cylinder 162 to carry away liquid which may surge upward from the primary and secondary pumping chambers (i.e. chambers 20 and 74, respectively, of FIG. 1) when rotation of the shaft 170 is halted. Such a housing 114 may also be useful where the secondary pump is designed to slow but not completely stop the flow of fluid through the second fluid gap 102. The lower edge 166*a* of the second partition plate has been shown contoured to mate with a cylindrical section 72 but may be formed integrally therewith. Shaft driving means are again indicated diagrammatically by a cylinder 160.

It will be appreciated by one skilled in the art that where there is no danger that a fluid head will be created at either the inlet 22 or outlet 28 of the apparatus 10 which will force the fluid being pumped above the secondary pumping chamber 74 when the shaft 70 is not being driven and if the secondary impeller 50 is designed to produce a maximum pressure in the fluid at least as great as the maximum pressure produced by the primary impeller 32, the reservoir chamber 64 will not be needed to protect the drive means 60 from the fluid being pumped. It should further be appreciated that for the envisioned use of the depicted preferred embodiment (i.e. in conjunction with an ice maker) that the major components of the embodiment (with perhaps the exception of the fasteners 76, 82, and 88, the O-ring 80 and shaft 70) can be easily formed formed molded plastic material for ease of construction and assembly and reduced cost.

While a preferred embodiment of the invention has been described and some modifications thereto suggested, other modifications to the operation and components of the preferred embodiment will no doubt appear to those skilled in the art. Therefor, the above description of the invention should be considered exemplary only and not as a limitation upon its scope which is more properly defined by the following claims.

What is claimed is:

1. A fluid pumping apparatus comprising:

a housing;

a first pump chamber within the housing;

a fluid inlet into the housing and first chamber;

a fluid outlet from the first chamber and housing;

a second pump chamber within the housing and above the first chamber when the apparatus is in use;

first partition means of the housing defining a wall of the first pump chamber and a wall of the second pump chamber;

second partition means of the housing defining a wall of the second pump chamber and separating the two pump chambers from a remaining portion of the housing;

a first rotary impeller in the first chamber for urging a fluid from the inlet through the outlet;

rotable shaft means extending vertically through the second partition means, the second chamber and the first partition means, and into the first chamber for driving the first rotary impeller;

a first fluid passage around said shaft means through said first partition means;

a second fluid passage around said shaft means and through said second partition means; and a second rotary impeller located in the second chamber primed with the fluid and operating on the fluid and driven by the rotatable shaft means for resisting the flow of the fluid passing through the first fluid passage from the first chamber into the second chamber towards the second fluid passage and urging the fluid from said second pump chamber through said first fluid passage and into said first pump chamber.

2. A fluid pumping apparatus comprising:

a housing;

a first pump chamber within the housing formed by a lower wall, a side wall and an upper wall;

a second pump chamber within the housing and above the first chamber when the apparatus is in use;

first partition means of the housing defining the upper wall of the first pump chamber and a lower wall of the second pump chamber;

second partition means of the housing defining an upper wall of the second pump chamber and separating the two pump chambers from a remaining portion of the housing;

a fluid inlet through the housing and first pump chamber lower wall into the first pump chamber;

a fluid outlet through the housing and a side wall from the first pump chamber;

rotatable shaft means extending vertically through the second partition means, the second chamber and the first partition means, and into the first chamber for driving a first impeller means;

a first fluid passage around said shaft means through said first partition means;

a second fluid passage around said shaft means and through said second partition means;

a first rotary impeller means in the first chamber for urging a fluid from the inlet through the outlet and for urging a portion of the fluid in the chamber under pressure through said first fluid passage; and a second rotary impeller means located in the second chamber primed with the fluid and operating on the fluid and driven by the rotatable shaft means for resisting the flow of the fluid passing through the first fluid passage from the first pump chamber into the second pump chamber towards the second fluid passage and adapted for urging the fluid from said second pump chamber through said first fluid passage and into said first pump chamber.

* * * * *